United States Patent [19]

Troncoso

[11] Patent Number: 4,865,008

[45] Date of Patent: Sep. 12, 1989

[54] DISAPPEARING ARCHERY ARROW GUIDE

[75] Inventor: Vincent F. Troncoso, Montrose, Colo.

[73] Assignee: Golden Key-Futura, Inc., Montrose, Colo.

[21] Appl. No.: 188,028

[22] Filed: Apr. 29, 1988

[51] Int. Cl.[4] ..... F41B 5/00

[52] U.S. Cl. ..... 124/41 A; 124/88

[58] Field of Search ..... 124/41 A, 24 R, 86, 124/88

[56] References Cited

U.S. PATENT DOCUMENTS

| | | | |
|---|---|---|---|
| 3,935,854 | 2/1976 | Troncoso | 124/24 R |
| 4,318,390 | 3/1982 | Trotter | 124/41 A |
| 4,476,846 | 10/1984 | Carville | 124/41 A |
| 4,492,214 | 1/1985 | Kielhoffer | 124/24 R |
| 4,662,346 | 5/1987 | Laffin | 124/41 A |
| 4,664,093 | 5/1987 | Nunemaker | 124/24 R |

OTHER PUBLICATIONS

"Golden Key Archery Products", advertisement, Archery, Nov. 1978, p. 13.

"Precision Shooting Equipment", advertisment, Bow and Arrow, Oct. 1986, p. 5.

*Primary Examiner*—Randolph A. Reese

*Assistant Examiner*—John A. Ricci

*Attorney, Agent, or Firm*—Donald E. Nist

[57] ABSTRACT

The disappearing archery arrow guide is used with archery bows containing overdraw shelves although it is also applicable to conventional non-overdraw shelves, as well, with arrow rests in the normal position. The guide includes a pair of upraised tines, preferably joined by a lower horizontal bar to form a U-shaped configuration. The bar is in turn connected to the upstanding collars of a bracket having a flat horizontal plate which is connectable to the upper surface of an archery bow shelf. The bracket is provided with a spring, such as a coiled spring, for biasing the tines into the flat position. The tines are spaced laterally from each other a distance sufficient to allow free passage of the shaft of an archery arrow therebetween but insufficient to permit the free passage of the broadhead of a hunting arrow. Instead, the broadhead has the effect of moving, during drawing of the arrow, the tines from the upright operative position to a flat horizontal position (inoperative position) by bumping the tines. Thus, during the draw, the tines prevent the arrow from rolling off the shelf or arrow rest, until the tines are flattened by the broadhead at nearly the end of the draw. Thus, the broadhead moves rearwardly, urging the tines out of the way, permitting free passage of the arrow after it is shot from the bow. In order to aid in holding the tines vertical, one or more detents may be provided in the guide. The guide may also include a handle on one of the tines to assist in moving the tines into the operative position. The guide can be made of metal and is inexpensive and durable.

5 Claims, 2 Drawing Sheets

DISAPPEARING ARCHERY ARROW GUIDE

BACKGROUND OF THE INVENTION

1. Field of the Invention

The present invention generally relates to archery equipment and more particularly relates to an improved disappearing archery arrow guide.

2. Prior Art

Overdraw shelves are becoming popular because they permit the use of shorter and thus lighter arrows which shoot at a faster speed, exhibiting a flattened trajectory, thus increasing accuracy and improving kill chances with hunting arrows. An overdraw shelf is one which is attached to the bow's shelf and extends rearwardly therefrom, and in the broader sense as used in this application, includes regular bow shelves to which the arrow rest is attached at a point rearward of its normal position, so that a shorter arrow can be fired from the rest for the desired effect. It has been found that for every six grains of excess arrow weight removed by using a shortr arrow, one foot per second in improved arrow speed is gained. Because the arrow is shorter, it is also stiffer, so that in some instances a thinner walled, lighter arrow can be used, further increasing the speed of the arrow.

Unfortunately, the shorter the arrow, the greater the danger during the draw, especially the early part of the draw, it is very easy to cause the arrow to roll off the rest.

Arrow roll-off is particularly dangerous when razor sharp broadheads are used with the arrows. Once the broadhead during the draw reaches a point which is behind the archer's hand, which is perched on top of the overdraw shelf, the situation becomes critical, roll-off at this point can possibly result in the broadhead slicing the archer's hand and causing serious injury.

Accordingly, there is a need for an improved device which will prevent arrow roll-off, particularly with broadhead bearing overdraw arrows, thus eliminating the previously described danger. The device should be simple, durable and efficient and be applicable to non-overdraw and overdraw applications as well.

SUMMARY OF THE INVENTION

The improved arrow guide of the present invention satisfies all the foregoing needs. The guide is subtantially as set forth in the Abstract of the Disclosure. Thus, the guide includes a generally "U" shaped member having a pair of laterally spaced upraised tines defining a space through which the shaft of an arrow freely passes but which is too narrow to allow the free passage of the broadhead of a hunting arrow therethrough. The lower ring or horizontal bar of the U-shaped member is pivotally connected to the upraised collars or ears of a horizontal plate of a bracket connectable to the upper surface of a bow shelf. One or both ears has one or more detents which temporarily hold the tines upright against the bias of a spring around the bar and connected to one tine. The spring keeps the tines horizontal and out of the way when forced flat by the broadhead during the draw.

Thus, the device is simple but effective. It provides a guideway for the arrow shaft until the tines are forced horizontal by the broadhead late in the draw. After they are flat, the tines are wholly out of the way of the arrow when it is fired. When it is desired to raise the tines, a handle on one tine is used to move the tines up past a detent on one or both collars so as to lock them in place in the upright operative position for reuse. Further features of the improved guide of the present invention, and the components thereof are set forth in the following detailed description and accompanying drawings.

DRAWINGS

DETAILED DESCRIPTION

FIGS. 1–5 and 7

Figure 1:
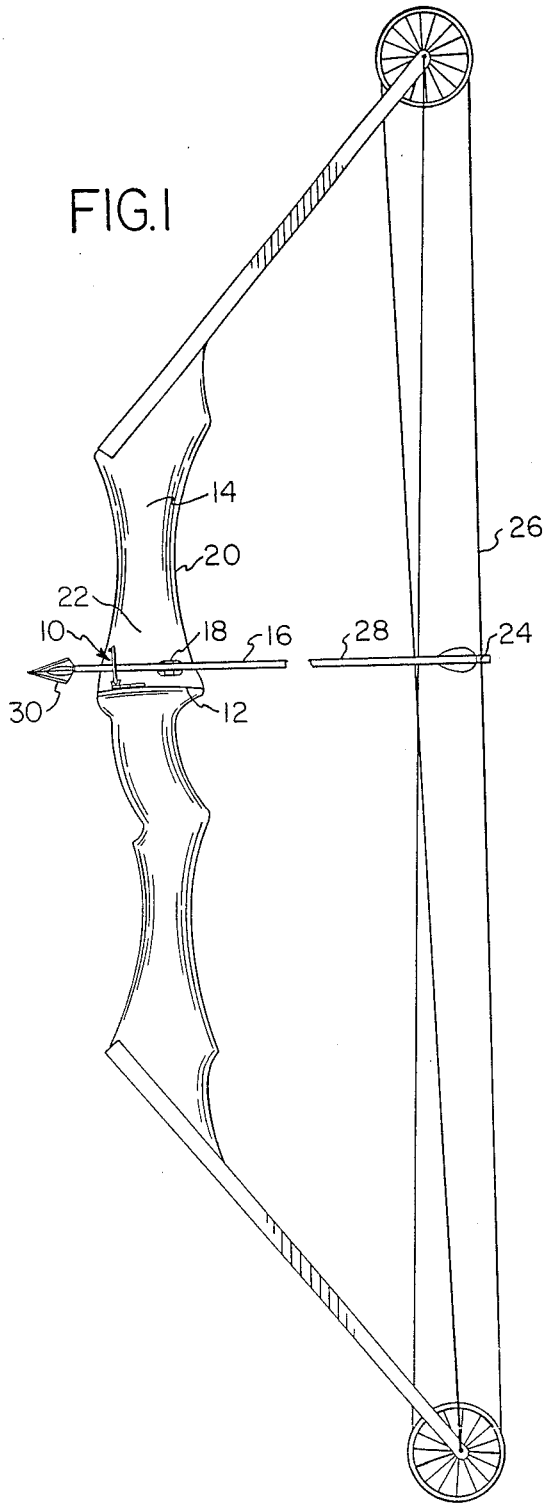
FIG. 1 is a schematic side elevation of a preferred embodiment of the improved arrow guide of the present invention, shown on a compound bow having the arrow rest in a normal position.

Now referring to FIGS. 1–5 and 7 of the accompanying drawings, a preferred embodiment of the improved guide of the present invention is schematically depicted therein. Thus, in FIG. 1 guide 10 is shown mounted on the arrow shelf 12 of a compound archery bow 14. An arrow 16 is also shown resting on a rest 18 positioned in a normal position on the sidewall 20 of a window 22 in bow 14. The rear end 24 of arrow 16 is shown nocked on bowstring 26, while the shaft 28 of arrow 16 extends through guide 10 and the broadhead 30 of arrow 16 extends in front of bow 14.

Figure 2:
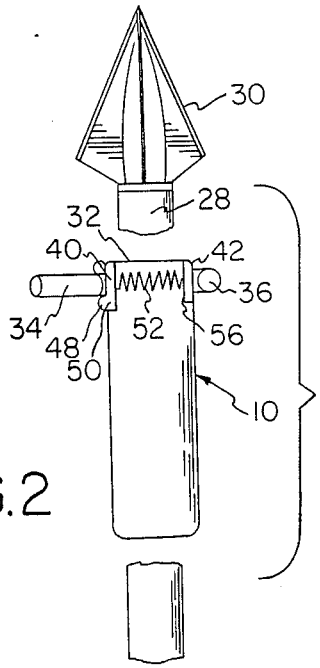
FIG. 2 is an enlarged fragmentary schematic view of the broadhead, guide and arrow shaft of FIG. 1.

Shaft 28 has a diameter less than that of space 32 between upright tines 34 and 36 of guide 10, while broadhead 30 has a diameter greater than the diameter of that space 32 (see FIG. 2) Tines 34 and 36 are joined to bottom crossbar 38 to form a U-shaped configuration. Bar 38 is pivotally connected to the vertical spaced ears or collars 40 and 42 of bracket 44 which also includes a horizontal plate 46, connectable to the upper surface of shelf 12, as by double sided tape, glue, screws, etc. (not shown). In fact, collars 40 and 42 are integral with plate 46. At least one collar 40 or/and 42 bears a friction detent 48 bulging out on its outer or side surface 50 to releasably lock tines 34 and 36 in the upright position against the biasing force of spring 52, one end 54 of which is connected to tine 34 and the opposite end 56 of which bears against the top of plate 46 (FIG. 2). Collar 40 and/or 42 may also include a forward stop or detent 51 bulging out on its outer surface 50 ahead of detent 48 to prevent tines 34 and 36 from pivoting down forwardly, (see FIG. 7).

Figure 3:
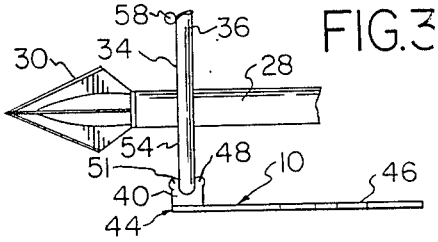
FIG. 3 is an enlarged schematic side elevation of the broadhead and guide before the broadhead forces the guide into the inoperative horizontal position.
Figure 4:
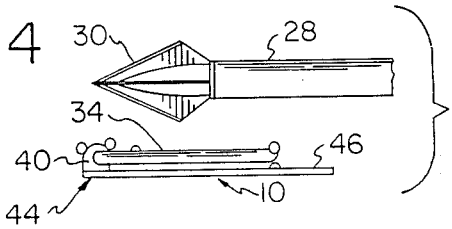
FIG. 4 is an enlarged schematic side elvation of the broadhead and guide of FIG. 3, with the guide shown horizontal, after being forced into that position by the broadhead.
Figure 5:
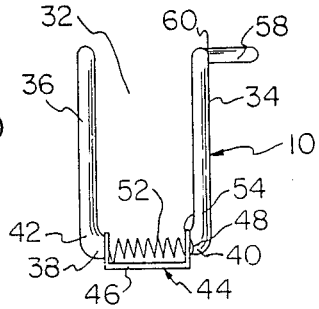
FIG. 5 is an enlarged schematic front elevation of the guide of FIG. 1.

As arrow 16 is drawn back by the archer, shaft 28 is guided by tines 34 and 36 which are in the upright position of Figs. 1,3 and 5, held in such position by detent 48 and abuts stop 51. Tines 34 and 36 are made of resilient wire or the like and may be covered with a layer of plastic 60 of a soft nature so as to give additional protection and cushioning to tines 34 and 36.

Tines 34 and 36 prevent arrow 16 from rolling off rest 18. When broadhead 30 passes rearwardly into contact with tines 34 and 36 during the arrow draw, it pushes tines 34 and 36 rearwardly past detent 48, causing them to pivot into the collapsed position of FIG. 4, horizontal and parallel to plate 46, as shown, and totally out of the path of arrow 16. Spring 52 helps keep tines 34 and 36 in this collapsed position until it is to be reused.

Accordingly, the archer's hand is fully protected against injury from arrow roll-off which does not occur. Guide 10 is reuseable and durable, simple, inexpensive to make and repair and highly efficient. It can be made in a variety of shapes and forms with open tops and guide sides spaced apart a sufficient distance to allow free passage of shaft 28 thgere between while preventing broadhead 30 from moving rearwardly therethrough without urging tines 34 and 36 into collapsed position. Further advantages are set forth in the foregoing.

FIG. 6

Figure 6:
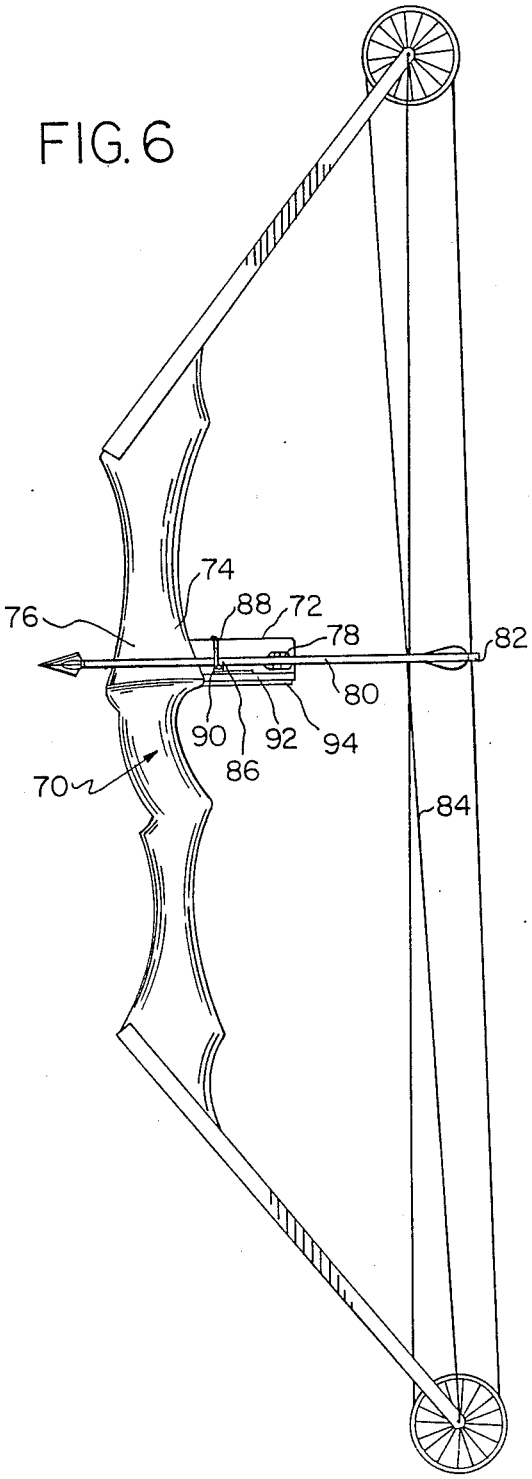
FIG. 6 is a schematic side elevation of a compound archery bow bearing an overdraw shelf and the improved arrow guide of the present invention as shown in FIGS. 1–5; and, FIG. 7 is a schematic enlarged fragmentary side elevation of the detent portion of the bracket of the improved arrow guide of the present invention.
Figure 7:
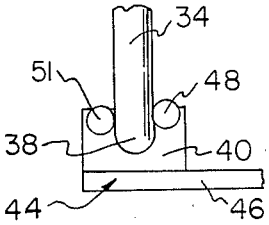

A compound archery bow 70 is schematically shown in FIG. 6 inside elevation, bearing an overdraw shelf 72 attached to the sidewall 74 of bow 70, as by double sided tape, glue, screws, etc. (not shown) and extending rearwardly of the bow window 76. Shelf 72 bears arrow rest 78 near the rear end thereof directly behind window 76, with arrow 80 resting on the rest 78 and with its rear end 82 nocked on bowstring 84. Bow 70 also includes a shelf 72 forward of rest 78 an improved arrow guide 86 identical in all respects with guide 10, including a U-shaped, tine-bearing component 88 pivotally connected to the vertical upraised collars 90 of a horizontal upper surface 94 of overdraw shelf 72. Guide 86 performs identically to guide 10 and has all the advantages thereof.

Various modifications, changes, alterations and additions can be in the improved guide of the present invention, its components and parameters. All such modifications, changes, alterations and additions as are within the scope of the appended claims form part of the present invention.

What is claimed is:

1. An improved disappearing open-topped archery arrow guide for archery bows with and without overdraw shelves, said guide comprising, in combination:

a. a pair of laterally spaced about upright arrow guiding tines defining an arrow shaft space therebetween, the spacing of said tines being less than the diameter of an archery hunting arrow broadhead but greater than that of said shaft; and, b. means interconnecting said tines for simultaneous movement thereof between said upright position, the operative position for said tines, and a collapsed about horizontal inoperative position for said tines, said tines being adapted to guide the shaft of an arrow and prevent its roll off of an archery arrow rest during drawing of the arrow before shooting thereof, said interconnecting means including a horizontal cross bar interconnecting said tines to form a generally U-shaped configuration, said interconnecting means also including a bracket having a flat horizontal plat mountable on an archery bow arrow shelf and bearing a pair of upstanding collars through which said horizontal bar is trained for pivoting of said tines between said operative position and said inoperative position, at least one of said collars bearing a friction detent which releasably holds said tines in said operative position when moved thereto by an archer.

2. The improved guide of claim 1 wherein said bracket is connected to a coiled spring which biases said tines into said inoperative position.

3. The improved guide of claim 2 wherein said guide is metal and wherein said tines are vertical.

4. The improved guide of claim 2 wherein the upper end of one of said tines bears an outwardly directed handle to assist in moving said tines from said inoperative position to said operative position.

5. The improved guide of claim 4 wherein said spring extends around said horizontal bar in said bracket and connects to one of said tines.

* * * * *